United States Patent [19]

Gelbard

[11] 4,344,294

[45] Aug. 17, 1982

[54] THERMAL DELAY DEMAND DEFROST SYSTEM

[75] Inventor: Robert B. Gelbard, Louisville, Ky.

[73] Assignee: General Electric Company, Louisville, Ky.

[21] Appl. No.: 174,054

[22] Filed: Jul. 31, 1980

[51] Int. Cl.[3] ..... F25D 21/06

[52] U.S. Cl. ..... 62/155; 62/156

[58] Field of Search ..... 62/140, 155, 128, 156, 62/234

[56] References Cited

U.S. PATENT DOCUMENTS

| | | | |
|---|---|---|---|
| 2,463,027 | 3/1949 | Frie | 62/4 |
| 2,781,641 | 2/1957 | Foley | 62/4 |
| 3,460,352 | 8/1969 | Lorenz | 62/153 |
| 3,518,841 | 7/1970 | West, Jr. | 62/153 |
| 3,727,419 | 4/1973 | Brightman et al. | 62/155 |
| 3,898,860 | 8/1975 | Shepherd et al. | 62/155 |
| 3,899,895 | 8/1975 | Blanton et al. | 62/155 |
| 3,899,896 | 8/1975 | Bryant | 62/155 |
| 4,056,948 | 11/1977 | Goodhouse | 62/155 |
| 4,142,374 | 3/1979 | Ansted et al. | 62/155 |
| 4,209,994 | 7/1980 | Mueller et al. | 62/155 |

*Primary Examiner*—Albert J. Makay
*Assistant Examiner*—Harry Tanner
*Attorney, Agent, or Firm*—Frank P. Giacalone; Radford M. Reams

[57] ABSTRACT

A demand defrost control system having a timing circuit operable after a duration of time to energize a defrost heater including temperature responsive means for automatically altering the duration of time between defrost cycles.

8 Claims, 6 Drawing Figures

1

THERMAL DELAY DEMAND DEFROST SYSTEM

BACKGROUND OF THE INVENTION

This invention is a defrost control system for a refrigerator that automatically varies the length of time between defrosts in response to the rate of frost accumulation.

The accumulation of build up of frost on the evaporator of a refrigerator requires that a defrosting system be employed. Various automatic defrosting systems have been employed and are well known in the art. Typically, an automatic defrost system is controlled by an electro-mechanical timer which initiates operation of the defrost system at fixed intervals of clock time, or after the compressor has run a predetermined length of time. The rate at which frost forms on the evaporator is a function of the amount of water vapor in the air passing over the evaporator, the greater the water content the faster the frost accumulates. In a refrigerator, the amount of water vapor within the air to be cooled depends a great deal on the ambient conditions (i.e., room temperature and relative humidity) outside the refrigerator because ambient air is introduced into the refrigerator each time the door is opened and closed, and water vapor sources (e.g. wet produce and open containers of liquid) within the refrigerator. With defrost systems controlled only with respect to time and with a slow build up of frost, operation of the defrost system is sometimes initiated before any significant amount of frost has built up on the evaporator, thus resulting in a wastage of power to defrost the refrigerator when it is not required and exposing the items in the refrigerator to unnecessary defrost cycles.

Another defrosting system is one in which the number of door openings are counted and a defrosting cycle is initiated after a selected number of openings occur. This arrangement is disadvantageous in that an unused or little used refrigerator would not be defrosted even though a substantial frost deposit has built up.

SUMMARY OF THE INVENTION

A defrost control system is provided for a refrigerator of the type having a cabinet containing freezer and fresh food storage compartments separated by a partition that includes an inlet and outlet passageway. The evaporator is positioned in a chamber associated with the freezer compartment. An air supply means including fan means is positioned in the freezer compartment for circulating freezer compartment air over the evaporator and for directing a portion of the air through the fresh food compartment between the inlet and outlet passageways. The refrigerator compressor is arranged in a lower compartment of the cabinet. A defrost heater is provided in the evaporator chamber for melting frost from the evaporator. The temperature within the cabinet is controlled by a refrigerator temperature thermostatic switch that is responsive to the temperature in the fresh food compartment for controlling operation of the compressor and fan means.

The defrost cycle is initiated by a defrost timing motor connected in series with said thermostatic switch. A defrost frequency control means is arranged in the path of air passing through the partition outlet so that it senses the temperature of air passing therethrough. The defrost frequency control includes a temperature responsive switch means which is operable when the refrigerator temperature thermostatic switch is closed and the fan means is circulating relatively warm fresh food compartment air through the outlet to energize the defrost timer, and is operable when the refrigerator temperature thermostatic switch is open and the fan means is inoperative to open as colder freezer air back flows through the outlet to delay energization of the defrost timer motor during initial operation of the fan means to alter the normal period of times operation under control of the refrigerator temperature thermostatic switch until the temperature responsive switch once again senses the relatively warm fresh food compartment air passing through said outlet.

DESCRIPTION OF THE PREFERRED EMBODIMENT

Figure 1:
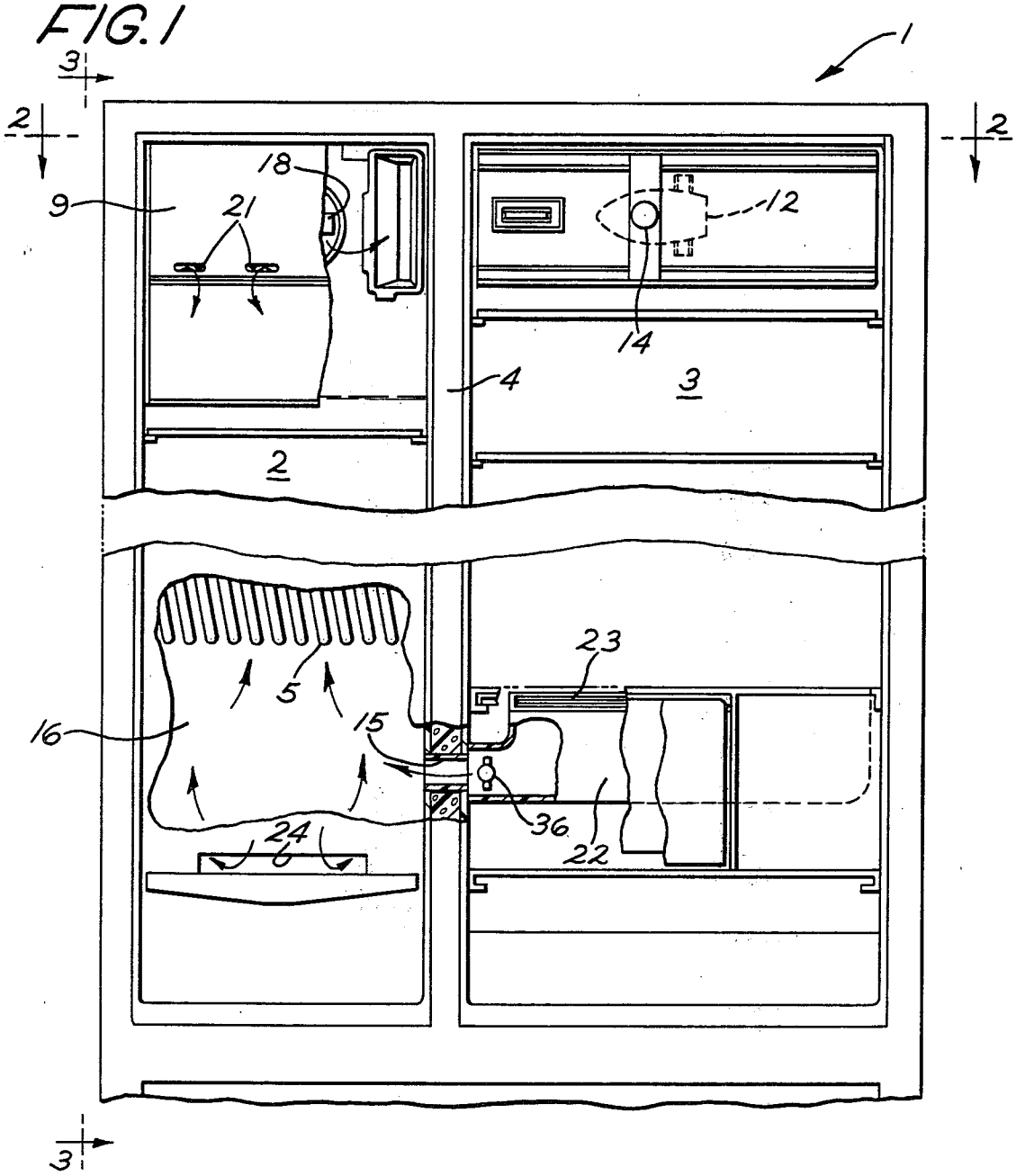
FIG. 1 is an elevational view of portions of a side-by-side combination refrigerator incorporating the present invention.
Figure 2:
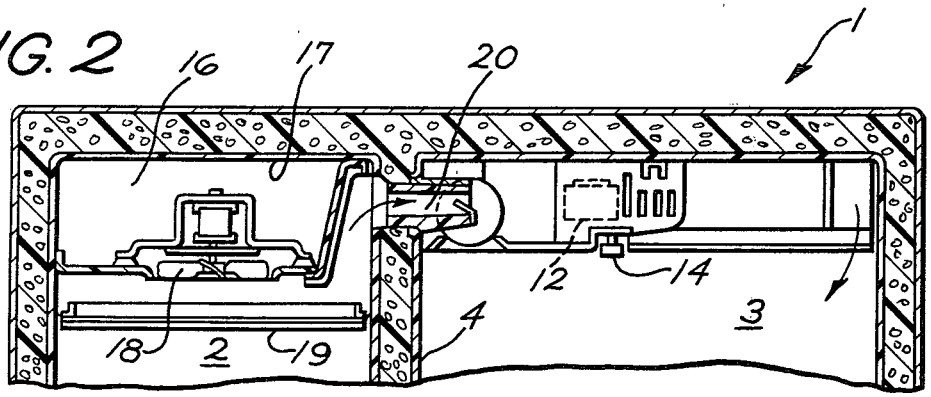
FIG. 2 is a sectional view taken generally along lines 2—2 of FIG. 1.

It should be understood that while in the preferred embodiment shown the present defrost system is incorporated into a side-by-side combination automatic defrost refrigerator having a forced air system, it is not limited thereto. The temperature excursion of the side-by-side single evaporator forced air system presents particular advantages in applying the present system; however, it may also be advantageously applied to top freezer mounted configurations when a flow of air is present.

With reference to the drawings there is shown a preferred embodiment of the present invention comprising a refrigerator cabinet 1 including a freezer compartment 2 and a fresh food storage compartment 3 arranged in side-by-side relationship and divided by means of a vertical partition 4. Cooling is afforded by an evaporator 5 connected in conventional series refrigerant flow circuit with a compressor 6, a condenser 8 and an expansion device (not shown). The compressor 6 and condenser 8 are arranged in a compartment 10 provided in the lower region of cabinet 1. Operation of the compressor 6 to establish desired temperatures is under control of an adjustable thermostat 12 provided with a knob 14 arranged in the fresh food compartment 3 so that it is responsive to temperatures of air therein.

Figure 3:
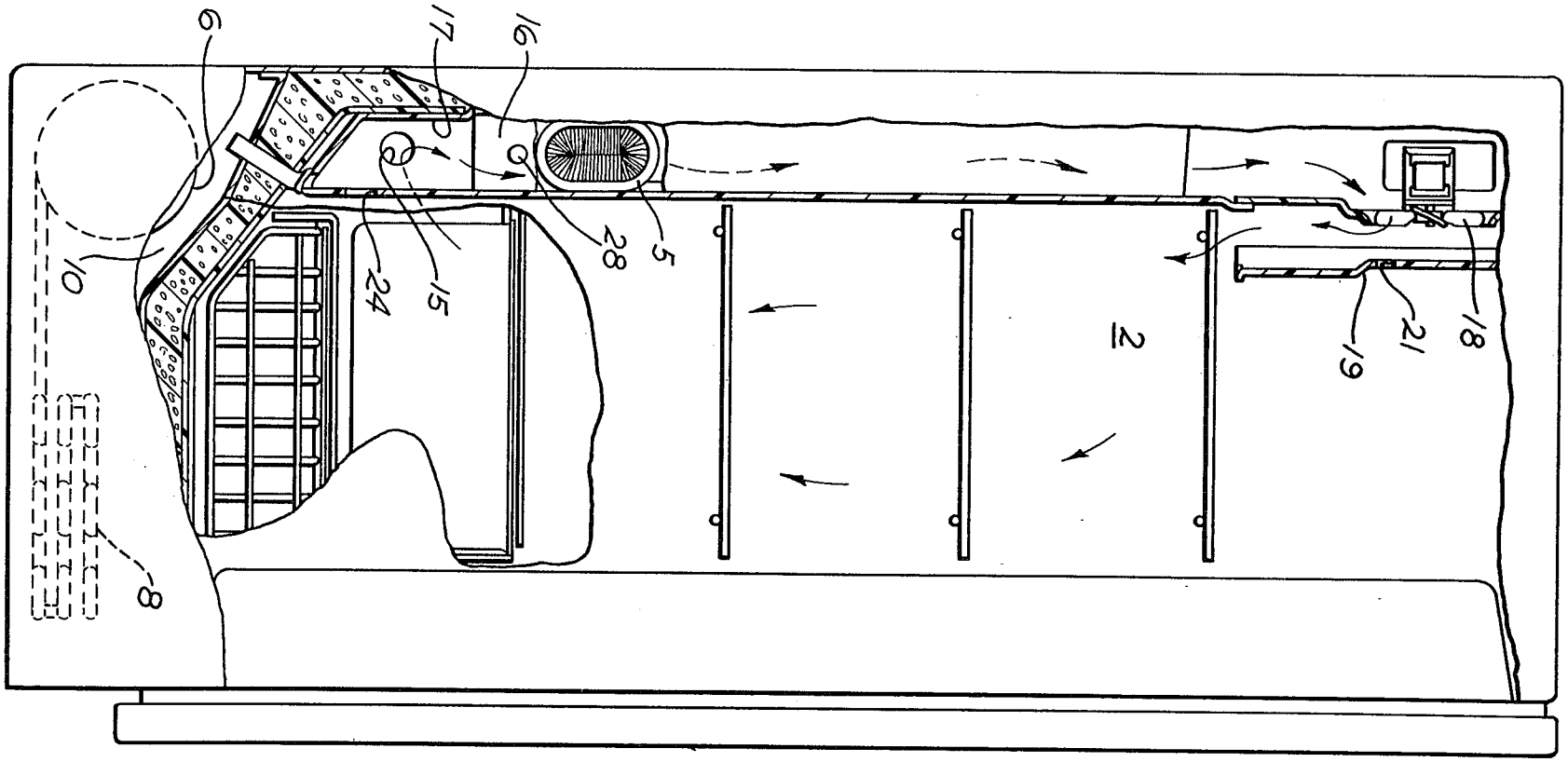
FIG. 3 is a vertical view of the cabinet 11 illustrated in FIG. 1 with parts broken away.

The evaporator 5 (FIGS. 1 and 3) for refrigerating the two compartments 2 and 3 is contained within an evaporator chamber or housing 16 extending vertically along the rear wall 17 of the freezer compartment. A single fan 18 mounted in the upper portion of the evaporator chamber 16 draws separate air streams from the two compartments 2 and 3 through the evaporator chamber 16 and discharges air cooled to below freezing temperatures by the evaporator 5 into the upper portion of the freezer compartment 2. A vertical baffle 19 extending substantially the full width of the freezer compartment 2 in front of the fan 18 diverts a minor portion of this refrigerated air to a fresh food air supply passage or inlet 20 provided in the partition 4 while the remaining and major portion of the refrigerated air flows generally downwardly into the freezer compartment 2 and forward through vents 21 in the vertical baffle 19. Air from the fresh food compartment is returned to the evaporator chamber 16 through an outlet 15 arranged in the lower portion of the partition 4. In order to facilitate the return of fresh food compartment air, a passageway or channel 22 is positioned on the rear wall of compartment 3. Air from compartment 3 enters opening 23 and passes through outlet 15.

Air from the freezer compartment 2 is drawn into the evaporator chamber 16 through a freezer air return passage 24 provided in the lower portion of the housing 16 below evaporator 5 while return air from the fresh food compartment 3 flows into the lower portion of the housing 16 through the fresh food air return or outlet passage 15 extending through the partition 4. These two air streams mix below the evaporator 5 and the mixed air is cooled by the evaporator 5 to below freezing temperatures.

The evaporator 5 is of the type designed to normally operate at below-freezing temperatures with the result that moisture contained in the air moving through the chamber 16 collects on the evaporator surfaces in the form of frost. Periodically, this accumulated frost is removed from the evaporator surfaces by energizing a heater 28 positioned in heating relationship with the evaporator surfaces. Although one heater is shown it should be noted that for the purpose of periodically warming the evaporator surfaces to defrosting temperatures, one or more radiant heaters may be positioned in radiant heating relationship with the evaporator. In the illustrated embodiment of the invention the single heater 28 is positioned below the evaporator 5 in the lower portion of chamber 16.

Typically, the fan 18 and compressor 6 are deenergized when a defrost operation is initiated and, at the same time, the radiant heater 28 is energized so that natural convection is allowed to melt the frost from the evaporator surfaces. In the present embodiment the defrost cycle may be initiated at predetermined spaced time intervals, such as by a timer 34.

By the present invention a variable defrost timing circuit is provided to alter the spaced time intervals at which defrost cycles are initiated. To this end a temperature responsive defrost frequency control 36 is arranged in passageway 22 adjacent the outlet 15 so that return air from the fresh food compartment 3 passes over it and, as will be explained hereinafter, it is also exposed to back flow of air from the freezer. The control 36 includes a conventional temperature responsive switch 37 which closes when the temperature passing through the outlet 15 goes above a selected temperature or range of temperatures and which opens when the temperature it senses goes below a selected temperature range. By positioning the defrost frequency control 36 in passageway 21 and more particularly in the path of air flowing through the passageway or outlet 15 it may be calibrated as in the present instance to close in response to sensing the relatively warm fresh food compartment air of approximately 36° F. as it is drawn back into the evaporator to be cooled and recirculated as mentioned above, and to open during the compressor and fan off cycle when the relatively colder freezer compartment air of approximately 22° F. back-flows through the outlet 15 into the lower portion of the fresh food compartment. The application of the defrost frequency control 36 and its function in the defrost timing circuit will now be explained in detail.

The circuit includes the thermostatic switch 30 of thermostat 12, a timer circuit 34 of timer 32, the compressor 6, fan 18, and the defrost frequency control 36 connected to electrical terminals 38 and 40. The thermostatic switch 30 is a conventional temperature responsive switch which closes when the temperature in the fresh food compartment 3 goes above a selected temperature or range of temperatures and which opens when the temperature within the compartment 3 goes below the selected temperature range. The timer unit 34 includes cycling means such as a timer motor 32 connected in series with the thermostatic switch 30 and the defrost frequency control 36 across power terminals 38 and 40. A single-pole double-throw (SPDT) switch 42 has a contact arm 44 operable by the timer motor 32 and connected through the thermostatic switch to the power terminal 38. One terminal of the motor compressor 6 is connected to a first or normally closed contact 46 of switch 42 while the other motor compressor terminal is connected to the power terminal 40. The second or normally open contact 48 of switch 42 is connected to one side of the heater which has its other side connected to terminal 40. The contact arm 44 opening means 50, such as a cam driven by the timer motor 32 of timer 34 is such that the contact arm 44 engages the contact 46 during a first selected period of operation of the timer motor 32 and the contact arm 44 engages the contact 48 during a second selected period of operation of the timer motor.

In operation the present circuit permits a substantially lesser defrosting frequency of the refrigerator evaporator than is necessary in the presence of more severe conditions such as high humidity. The defrost frequency control changes the operation of the defrost timer motor 32 between defrost periods.

When the thermostatic switch 30 is closed, the timer motor 32 advances to cycle the contact arm 44 between contacts 46 and 48 and alternately energizes the refrigerator compressor 6 and fan 18, and the defrost heater 28, respectively. Operation of the compressor 6 and fan 18 results in cooling of the compartments 2 and 3, and operation of the defrost heater 28 results in the removal of frost from the evaporator 5. Energization of the timer motor 32 when the thermostatic switch 30 is closed is through the series arranged defrost frequency control switch 37. In effect the timer advancement is under control of the defrost frequency control.

In normal operating conditions the switch 37 which as stated above is calibrated to close when it senses a relative warm fresh food compartment air of 36° F. as it passes through outlet 15 under influence of fan 18. When the operation of compressor and fan are terminated by thermostatic switch 30 the colder below freezing air in compartment 2 and more particularly in chamber 16 will back-flow through outlet 15. The location of the outlet 15 in the lower portion of the cabinet and in communication with the evaporator chamber 16 is of particular advantage when the present system is applied to a side-by-side refrigerator cabinet. This colder air will cause switch 37 to open at approximately 22° F. and remain open under influence of the colder air. When the thermostatic switch 30 closes in response to fresh food compartment temperature the compressor and fan will once again be energized, however the timer remains deenergized since switch 37 under influence of the colder freezer air is open and the timer will not advance. As the compressor and fan continue to operate the warmer fresh food compartment air passing through outlet 15 will cause switch 37 to close and complete the circuit through timer motor 32 after a duration of time. The cumulative duration that the switch 37 is open during one period of time when the contact arm engages contact 46 is thus added to the normal period of time of the timer between successive defrost periods.

The incorporation of the air temperature responsive defrost frequency control 36 in the timing circuit provides for less use of the defrost heater, when conditions permit, and thus a saving in expense of operation. Also, the particularly described switch and its location relative to the air stream that allows it to sense the differential temperature between the freezer and fresh food compartments provides a relatively inexpensive addition to the timing circuit.

Figure 5:
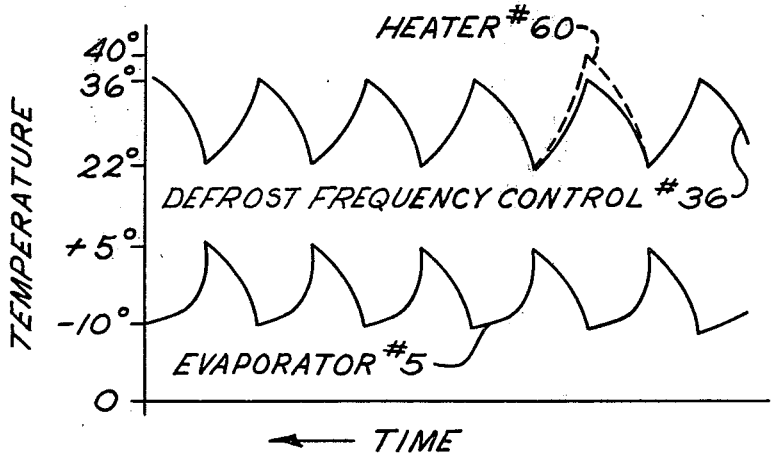
FIG. 5 is a chart showing temperature-time phase relationship of the frost frequency control with respect to evaporator temperature.
Figure 6:
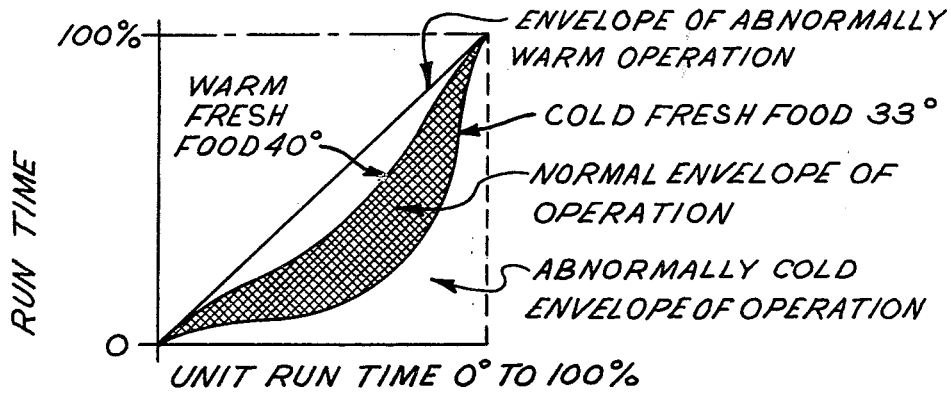
FIG. 6 shows the variation in timer delay between a fresh food compartment temperature of 40° F. and 30° F.

With reference to FIG. 5, it will be seen that the operation of switch 37 of the frequency control 36 is in opposite phase with the temperature of the evaporator. FIG. 6 shows the variation in timer delay between a fresh food compartment temperature of 40° F. and 33° F.

Figure 4:
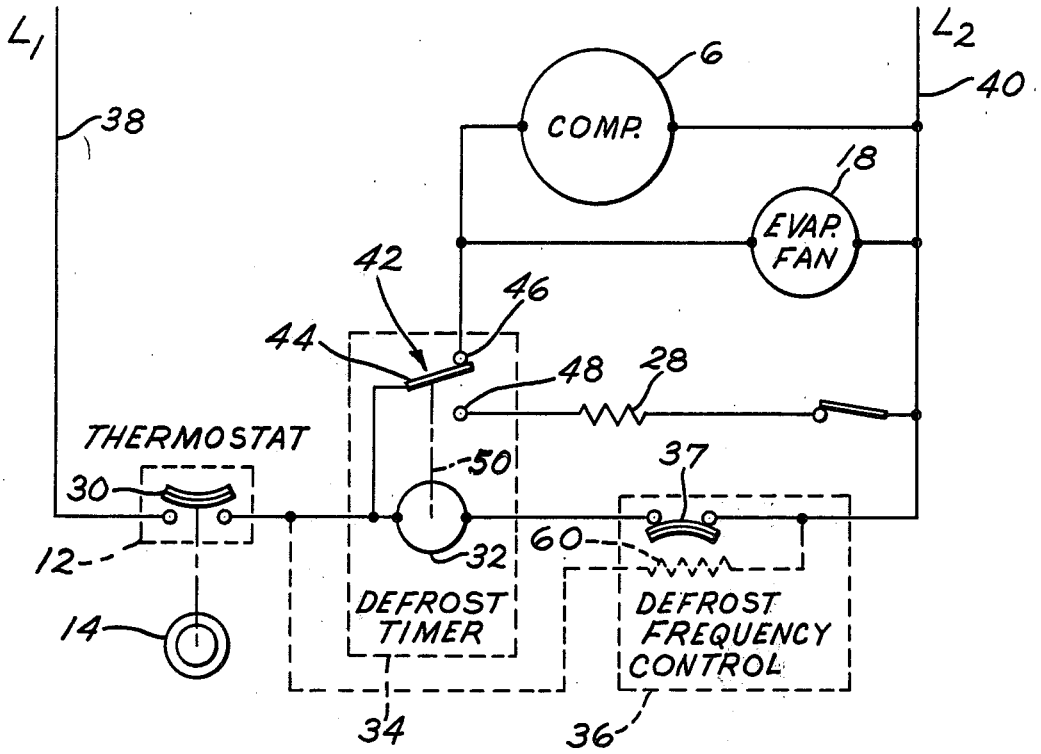
FIG. 4 is an electrical schematic of a defrost timing circuit in accordance with the invention.

In many instances, low cost temperature responsive switches employ a bimetal that requires a high temperature differential to operate the associated switch. To overcome this disadvantage, a heater 60 may be employed as part of the control 36. When used, the heater 60 would be arranged, as shown in dotted lines in FIG. 4, in parallel with the timer motor and bimetal switch 37. In operation, the heater 60 would work in phase with the thermal drive of the air circuit as shown in dotted lines in FIG. 5. The heater 60 would be energized with the compressor and would apply heat to bimetal switch 37 as it senses the warmer fresh food compartment air. When the compressor is deenergized, the back flow of air from the evaporator chamber opens the switch 37 in the same manner as when a heater is not employed.

FIG. 6 is a map of the defrost frequency control function across the range of refrigerator temperatures. It can be seen that as the fresh temperature rises, the frequency of defrost increases. If the refrigerator thermal load exceeds the ability of the refrigeration system to hold normal refrigerator temperatures, the defrost timer operation will approach the 45° line of operation. In this instance, the timer accumulates compressor running time because of the rapid warming of the defrost frequency control 36. When the door opening load, which directly influences the rate of evaporator frost accumulation, causes excessive freezer temperatures, the timer operation will be along the 45° line because the freezer air back flow through outlet 15 will not be cold enough to open switch 37 and cause a delay in the operation of timer motor 32. When the refrigerator temperature is very cold or close to the safe limits of fresh food operation, i.e. 33° F., the thermal delay will be maximum. That is, the timer operation will be minimal. Should the refrigerator freezer combination be operated either intentionally or by malfunction in such an abnormal manner that the fresh food section is driven down below freezing temperature, the defrost frequency control may not reach closing temperature, thus resulting in no timer operation as shown by the arrow along the abscissa of FIG. 6. Operation in this abnormal manner would continue until the refrigeration system could no longer maintain the abnormally cold temperatures at 100% compressor operation. Timer operation at 100% would then commence until a defrost occurred thus providing fail safe boundaries of timer operation throughout the range of normal and possible abnormal temperature operation. Thus, the change in defrost frequency is an analog of the actual need for defrosting the evaporator, and provides automatic demand defrost response within the normal usable boundaries of operating conditions.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

I claim:

1. A defrost control system including a timing circuit for a refrigerator of the type having a cabinet containing feezer and fresh food storage compartments separated by a partition;

an inlet and outlet passageway in said partition;

an evaporator chamber associated with said freezer compartment including an evaporator;

air supply means circulating freezing compartment air over said evaporator and for directing a portion of said air through said fresh food compartment between said inlet and outlet passageways;

a refrigerator compressor;

a defrost heater;

a thermostatic switch responsive to the temperature in said fresh food compartment for energizing said compressor;

a defrost timing motor connected in series with said thermostatic switch;

a defrost switch means in series with said thermostatic switch being operable by said defrost timer after a normal period of timer operation from a first switch position to complete a circuit to said compressor to a second switch position to complete a circuit to said defrost heater;

a defrost frequency control means arranged in the path of air passing through said partition outlet for sensing the temperature of air passing therethrough, including a temperature responsive switch means in said defrost frequency control being operable when said thermostatic switch is closed and said air supply means is circulating relatively warm fresh food compartment air through said outlet to energize said defrost timer, and being inoperable when said thermostatic switch is open and said air supply means is inoperative to open as colder freezer air back flows through said outlet to delay energization of said defrost timer motor during initial operation of said fan means to alter said normal period of timer operation until said temperature responsive switch once again senses the relatively warm fresh food compartment air passing through said outlet.

2. The defrost control system recited in claim 1 wherein said refrigerator cabinet is of the side-by-side type with said partition being vertically disposed therein, said inlet passageway is located in the upper portion of said partition and said outlet located in the lower portion of said partition.

3. The defrost control system recited in claim 2 wherein said air supply means further includes a fan arranged in the upper portion of said freezer compartment.

4. The defrost control system recited in claim 3 further including circuit means connecting said compressor and fan in parallel.

5. The defrost control system recited in claim 4 wherein said temperature responsive switch means is connected in series with said thermostat switch and said defrost timing motor.

6. The defrost control system recited in claim 2 further including a return air passageway in said fresh food compartment including an opening in said fresh food compartment and an outlet connected to said partition outlet for directing air circulating through said fresh food compartment into said partition outlet.

7. The defrost control system recited in claim 6 wherein said defrost frequency control means is arranged in said return air passageway.

8. The defrost control system recited in claim 7 further including a heater associated with said temperature responsive switch means being connected in series with said thermostatic switch means and parallel with said defrost timer and temperature responsive switch means operable to open said temperature responsive switch means after a predetermined duration of energization of said defrost timer.

* * * * *